United States Patent [19]

Murdock

[11] 4,189,730

[45] Feb. 19, 1980

[54] DIRECTIONAL ANTENNA SHIELD FOR A SLOTTED OPENING

[76] Inventor: Arthur W. Murdock, 6413 S. Whipple, Chicago, Ill. 60629

[21] Appl. No.: 909,949

[22] Filed: May 26, 1978

[51] Int. Cl.[2] ..... H01Q 15/02; H01Q 1/52

[52] U.S. Cl. ..... 343/841; 343/767

[58] Field of Search ..... 343/841, 842, 767–770; 333/84 L

[56] References Cited

U.S. PATENT DOCUMENTS 3,568,208 3/1971 Hatcher et al. ..... 343/768

*Primary Examiner*—David K. Moore

[57] ABSTRACT

A shield for use with a rotatable, elongated, cylindrical transmitter having a cylindrical insulator and a metal cylindrical shield on its exterior with both the insulator and shield having an elongated, slotted opening to permit reception of signals originating from one direction, but which shields signals originating from peripheral directions.

3 Claims, 6 Drawing Figures

DIRECTIONAL ANTENNA SHIELD FOR A SLOTTED OPENING

BACKGROUND OF THE INVENTION

This invention relates to elongated cylindrical receivers of the type used for receiving CB transmissions, and more particularly relates to a shield for such an antenna which permits reception of signals originating from one general direction while shielding signals originating from peripheral and other directions.

SUMMARY OF THE INVENTION

The receiver of the present invention effects the result of permitting reception of signals from one general direction while filtering out signals from peripheral and other directions by providing a standard citizens band receiver with an insulator coaxially coupled to the outside of the receiver and having an elongated slot formed therein, thus exposing a portion of the receiver along its length. The insulator is then coaxially coupled to an outside metal shield, also having a slot aligned with the slot in the insulator. Radio signals originating in the direction in front of the slotted opening are received by the receiver, but signals originating from other directions are filtered and shielded from the receiver by the outside cylindrical shield.

The main object of the present invention is to provide a citizens band receiver for use primarily in urban areas having a relatively high density of CB transmitters. In such an area, reception of citizens band signals is ofter hampered by the fact that interference is created due to the large number of transmitters in the area.

The present invention solves the problem of interference by providing a directional receiver which receives signals only originating from an angular area in front of the slotted opening provided on the receiver while filtering out other signals in the area. This permits the operator to choose the general direction from which reception is desired while filtering out signals from all other areas, including signals originating in close proximity.

Other objects and advantages of the present invention will become apparent upon reading the following description and upon reference to the drawing in which.

Figure 6:
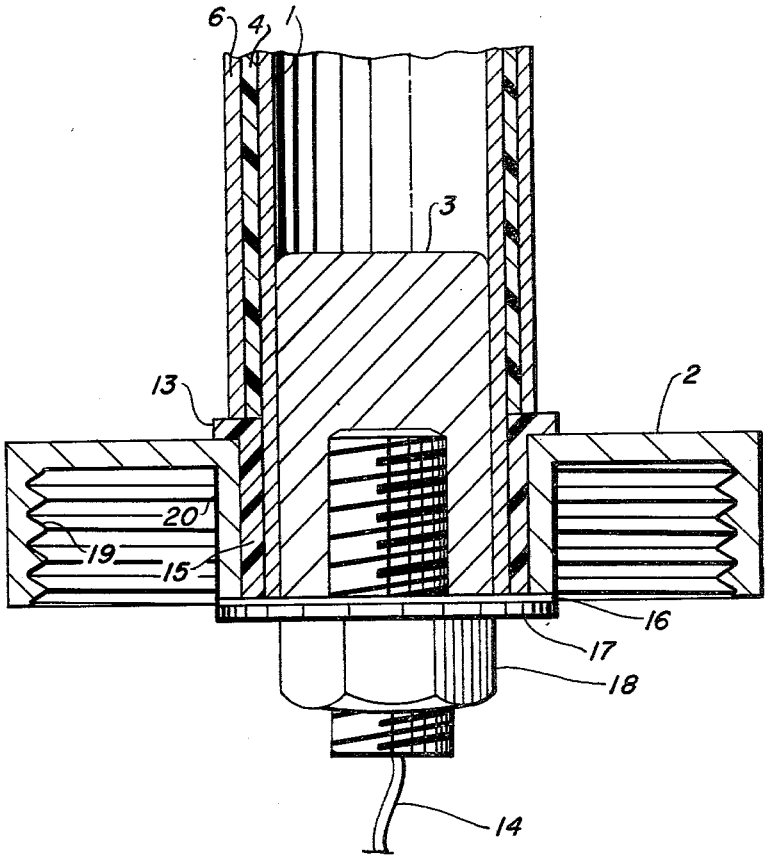
FIG. 6 is a view taken along the line VI—VI of FIG. 2.

A standard citizens band type receiver 1 of elongated cylindrical configuration coupled to an antenna wire 14 is mounted on base 2 (FIG. 1) by any convenient means, such as by means of a press fit on pedestal 3 as shown in FIG. 6. Base 2 is in turn coupled to any convenient means for rotational movement.

Figure 2:
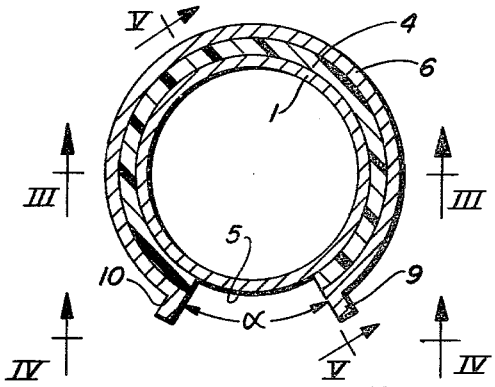
FIG. 2 is a view taken along the line II—II of FIG. 1.
Figure 3:
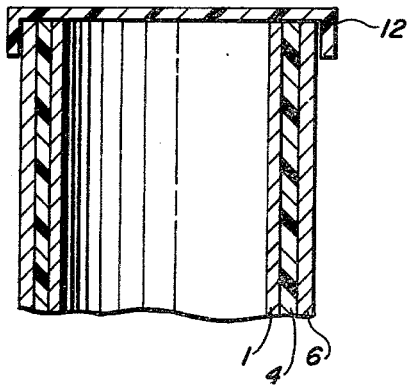
FIG. 3 is a view taken along the line III—III of FIG. 2.
Figure 4:
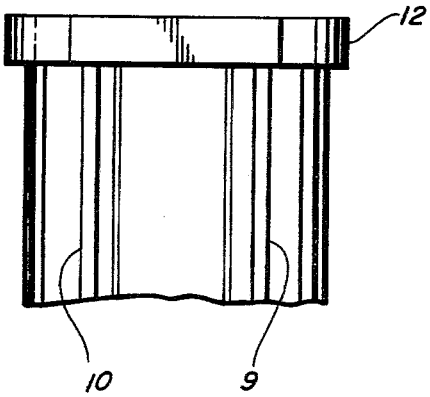
FIG. 4 is a view taken along the line of IV—IV of FIG. 2.
Figure 5:
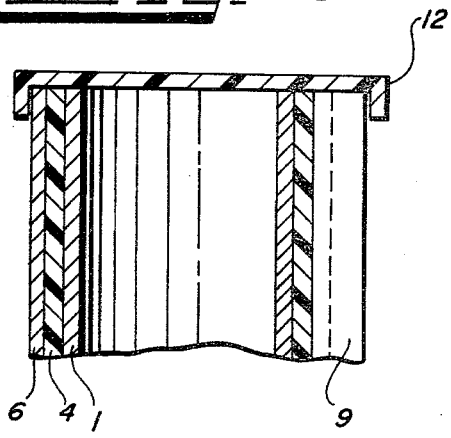
FIG. 5 is a view taken along the line of V—V of FIG. 2.

Turning now to FIG. 2, the insulating and shielding portions of the present invention will be described. A standard cylindrical transmitter 1 is coaxially coupled to a cylindrical insulator 4. The insulator 4 is made of plastic or any other nonconducting material. The insulator is provided with a through-going slotted opening substantially along its entire length, thus exposing a section 5 of transmitter. A protective cap 12 is provided to prevent rain and debris from entering the antenna.

Coaxially mounted on the insulator 4 is a shield 6, also of elongated cylindrical shape and also having a slotted opening of approximately the same size as the slotted opening in the insulator and in registry with the slot in the insulator. The shield 6 can be made of any suitable electrical-conducting material and can be made of the same material as the receiver 1.

Figure 1:
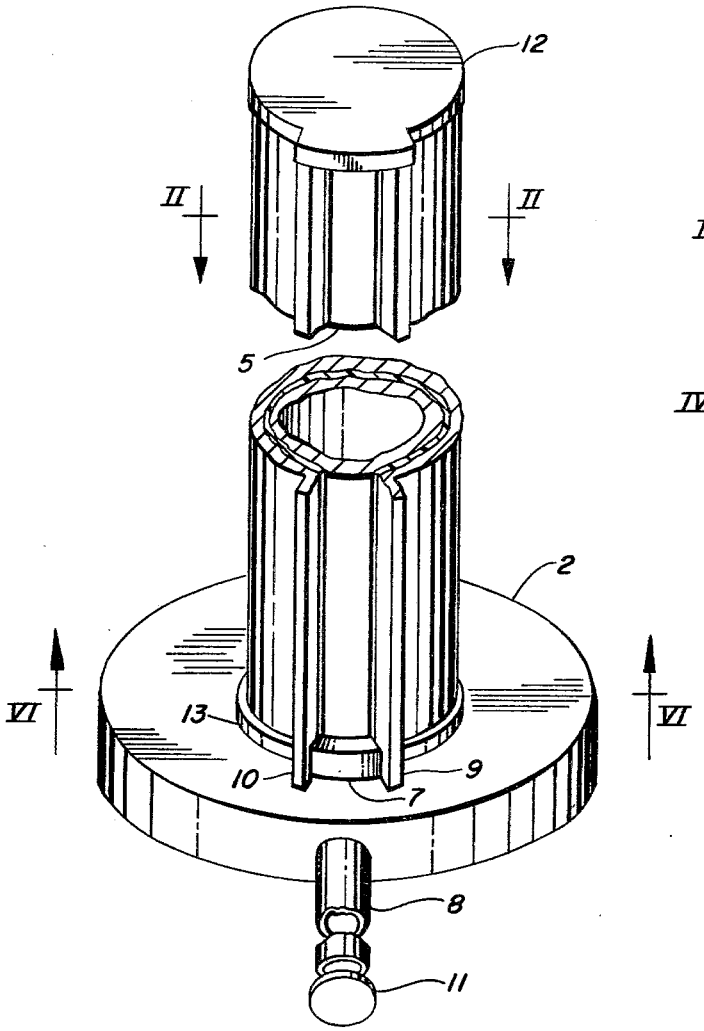
FIG. 1 is a perspective of the antenna and shield of the present invention.

Base 2 is provided with an upright key 7 having a width approximately equal to the width of the slotted opening in the insulator and shield. The insulator 4 is positioned around the antenna 1 either by spreading the insulator open and press fitting it over the antenna 1 or by sliding it down the length of antenna 1. In any event, in its final coaxial configuration with regard to the antenna, the slotted opening is aligned with key 7, thus maintaining the insulator in fixed relationship with the antenna. Of course, maintaining this fixed relationship can be accomplished by any convenient means. Shield 6 is likewise positioned coaxially with regard to antenna 1 and insulator 4 as shown in FIG. 1.

Base 2 is further provided with a single radial 8 projecting radially outward, directly in front of the slotted opening. A protective cap 11 is provided to protect the hollow radial from weather conditions. While in a typical CB antenna installation, several radials are required, since the antenna of the present invention only transmits and receives in a single direction, a single radial is sufficient.

In order to insure that signals received and shielded by shield 6 as well as signals received by radial 8 are not transmitted in any way to antenna 1, the antenna is fully insulated from both the shield and the base 2. As previously mentioned, insulator 4 accomplishes insulation substantially along the entire length of the unit. As shown in FIG. 6, the antenna is shielded at the region of base 2 by means of insulator 15 having a flange 13, the latter of which provides added insulation between the shield 6 and both the base 2 and antenna 1. As shown in FIG. 6, further insulating material is provided by way of an insulating washer 16 between the nut and washer combination 17, 18.

Also shown in FIG. 6 is a convenient means for mounting for rotational movement. As shown in FIG. 6, base 2 is threaded along its interior surface 19 for easy attachment to an exteriorly threaded pipe which can in turn be mounted in any convenient means for rotational movement. Also shown in FIG. 6, base 2 is provided with a sleeve 20 in order to receive the entire antenna assembly.

In operating the CB antenna of the present invention, base 2 is rotated so that the slotted opening is in the direction from which the user wishes to receive signals. Since the antenna is used both to receive as well as to transmit signals, the user is able to transmit signals in the same direction.

In order to permit the use of relatively thin-gauge material, both for the insulator and shield while still shielding out peripheral signals, it is preferable to provide shield 6 with radially projecting lips 9 and 10 on each side of the slotted opening as shown in FIGS. 1 and 2. As shown in FIG. 2, the amount by which the lips 9 and 10 project radially outward, as well as the width of the slotted opening, determine the angle, $\alpha$ of signal reception.

In operation, the receiver is positioned by rotating base 2 so as to point the slotted opening in the desired direction. When the receiver is fixed in place, signals originating from points other than points encompassed by the angular area, $\alpha$ as shown in FIG. 2 are absorbed by shield 6 and are dissipated. Since shield 6 is completely insulated from receiver 1, none of the signals originating from points other than area, alpha, are received. In order to make transmissions on the same unit, no adjustments are necessary since the unit is already aligned for transmission in the proper direction.

While the invention has been described in connection with a preferred embodiment, it will be understood that I do not intend to be limited to the particular embodiment shown and described above, but intend, on the contrary, to cover the various alternative and equivalent forms of the invention included within the spirit and scope of the claims.

I claim:

1. A shield for use wth a rotatable elongated receiver comprising an insulator coupled to the outside of the receiver, said insulator having a through-going slot substantially over its entire length and thus exposing a portion of the receiver, a slotted metal shield coaxially coupled to the outside of said insulator and fully insulated from said receiver and having a through-going slot in registry with the slot on said insulator, means for fixing said insulator and shield in fixed relationship to each other and to the receiver and feed means coupled to said receiver.

2. The invention, as claimed in claim 1, further comprising outwardly projecting lips on each side of said slot on the metal cylindrical shield.

3. The invention, as claimed in claim 1, wherein said receiver, shield and insulator are of cylindrical shape.

* * * * *